US005570976A

United States Patent [19]

Fuller et al.

[11] Patent Number: 5,570,976

[45] Date of Patent: Nov. 5, 1996

[54] CABLE BOLT

[75] Inventors: Peter G. Fuller, East Hawthorn; Paul O'Grady, Pyrmomt, both of Australia

[73] Assignee: J.J.P. Geotechnical Engineering Pty. Ltd., Australia

[21] Appl. No.: 182,016

[22] PCT Filed: Jul. 22, 1992

[86] PCT No.: PCT/AU92/00369

§ 371 Date: Jan. 21, 1994

§ 102(e) Date: Jan. 21, 1994

[87] PCT Pub. No.: WO93/03256

PCT Pub. Date: Feb. 18, 1993

[30] Foreign Application Priority Data

Jul. 26, 1991 [AU] Australia ..... PK7455

[51] Int. Cl.[6] ..... E21D 21/00

[52] U.S. Cl. ..... 405/302.2; 405/259.1; 405/288

[58] Field of Search ..... 405/259.1, 288, 405/302.2

[56] References Cited

U.S. PATENT DOCUMENTS

| | | | |
|---|---|---|---|
| 1,959,620 | 5/1934 | Eveno | 151/19 |
| 3,077,809 | 2/1963 | Harding | 405/302.2 X |
| 3,436,923 | 4/1969 | Ektorp | 61/53.52 |
| 4,247,224 | 1/1981 | Killmeyer | 405/260 |
| 5,230,589 | 7/1993 | Gillespie | 405/259.6 |

FOREIGN PATENT DOCUMENTS

| | | |
|---|---|---|
| 45140/79 | 9/1982 | Australia . |
| 0163479 | 12/1985 | European Pat. Off. . |
| 0379388 | 7/1990 | European Pat. Off. . |
| 587.764 | 4/1925 | France . |
| 588.521 | 5/1925 | France . |
| 600.809 | 2/1926 | France . |
| 1.014.500 | 8/1952 | France . |
| 3435117 | 4/1985 | Germany . |
| 3434020 | 3/1986 | Germany . |
| 3905128 | 1/1990 | Germany . |
| 3919103 | 12/1990 | Germany . |
| 380967 | 9/1932 | United Kingdom . |
| 554555 | 7/1943 | United Kingdom . |
| 1549190 | 7/1979 | United Kingdom . |
| 1589607 | 5/1981 | United Kingdom . |
| 2084630 | 4/1982 | United Kingdom . |
| WO90/05811 | 5/1990 | WIPO . |

*Primary Examiner*—Michael Powell Buiz
*Assistant Examiner*—Frederick L. Lagman
*Attorney, Agent, or Firm*—Moore & Hansen

[57] ABSTRACT

The present invention relates to the field of bolts, bars, wires, anchors and similar devices used for example as ground or rock support, reinforcement and anchors in geological environments such as mines, tunnels, etc. It also relates to stabilization and/or reinforcing applications for other geological ore earthwork applications. The invention is a cable bolt comprising at least two wires, and being adopted to have a nut threaded directly onto at least one of the wires. When the cable bolt is a multistrand (steel) cable, the outer wires (11) have a thread (13) formed upon them for a nut to engage. Alternatively, instead of a thread, a pattern of deformations could be used, then a nut or other member being locked onto these deformations. Preferably, the threads or deformations are rolled into the wires so that material is not removed and work hardening occurs.

11 Claims, 12 Drawing Sheets

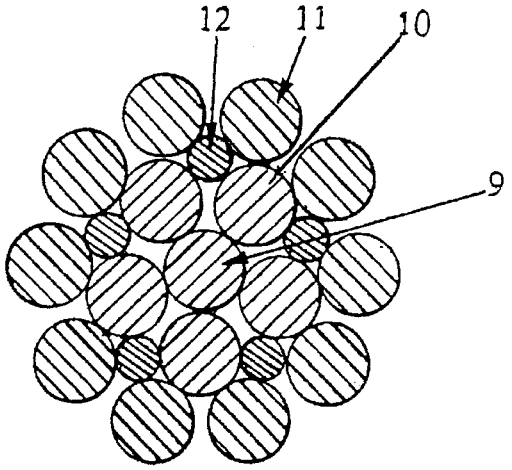
Fig 2.
Fig 4.
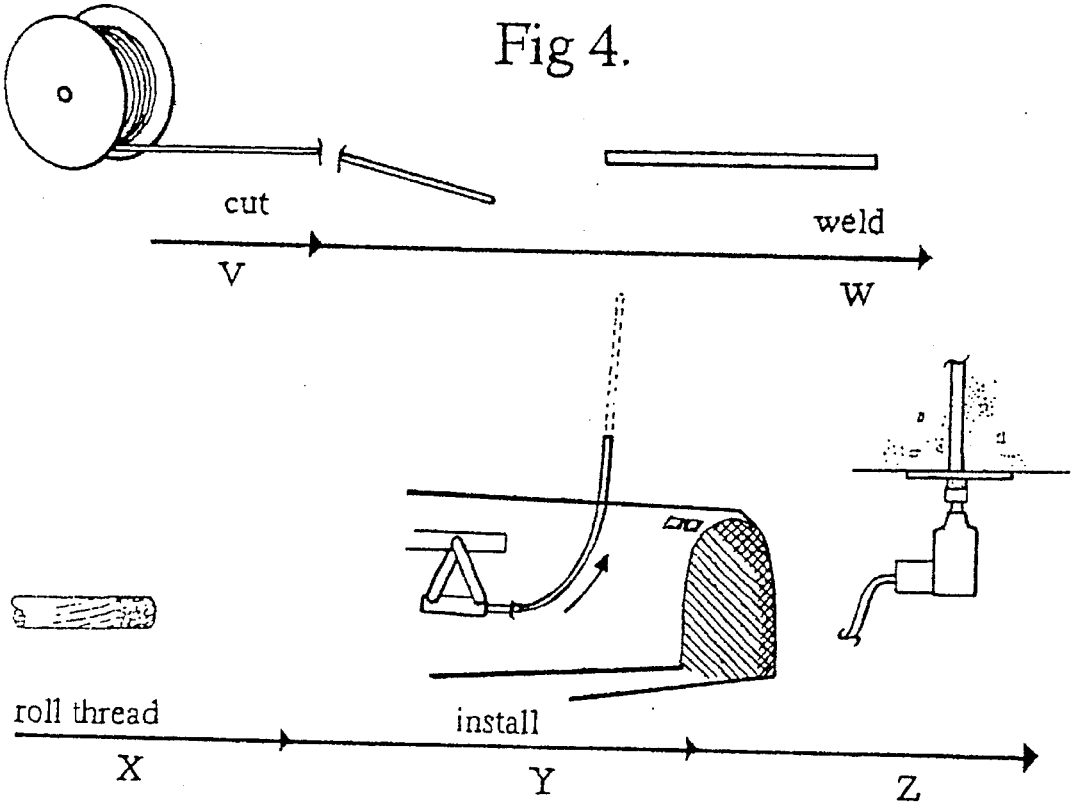

| | Configuration | Strand diameter range (mm) | Approximate wire diameter (mm) | |
|---|---|---|---|---|
|  | 1x7 (6/1 | 15.2 to 15.5 | centre<br>outer | 5.2<br>5.1 |
|  | 1x19 (9/9/1 | 21.0 to 21.4 | centre<br>inner<br>outer | 5.98<br>2.93<br>5.2 |
|  | 1x21 (10/5 + 5/1) | 22.8 to 23.3 | centre<br>inner<br>filler<br>outer | 4.2<br>4.8<br>2.3<br>5.3 |

CABLE BOLT

FIELD OF INVENTION

The present invention relates to the field of bolts, bars and wires and similar devices used for example, as ground or rock support and reinforcement in geological environments including underground mines or tunnels or other stabilisation applications and also more generally to reinforcing applications. The present invention also relates to end fittings or means for securing the bolts, bars or wires.

BACKGROUND ART

Numerous examples exist of types of rock or ground stabilisation bolts having the form of a rigid bar. The rigid bar generally has an elongated shank for insertion in a borehole drilled from an excavation into surrounding rock, which is to be contained or stabilised. The installed bar acts as a rock bolt, which together with a plate and nut provided at one end of the bar serve to reduce the risk of collapse of the rock forming the roof or walls or uplift of the floor of the excavation.

The borehole is usually drilled to a depth so that one end of the rigid bar and at least a portion of the length of the bar adjacent to this one end is secured to relatively stable rock by a fast setting resin mix, other grout formulation or mechanical anchor device.

Such rigid bars are often of limited use where a borehole must be drilled deep into the roof of the excavation before relatively stable strata is located or where thicker zones are to be reinforced. The rigid bars are relatively inflexible, and thus a bar of greater length than the height of the mine or tunnel or any other type of excavation cannot be installed without being plastically deformed and then straightened again before being inserted into the borehole. Rigid bars of a particular diameter also have a relatively limited load carrying capacity and therefore a relatively large number of rigid bars must be used over any given area to achieve the required support or reinforcing action.

A cable form of rock bolt is shown in German Patent Application DE3435117A. The cable form of rock bolt disclosed therein has a rigid end or sleeve portion formed at the end of the cable part of the bolt to enable a plate and nut to be fitted to the bolt. The rigid end is usually preformed on the cable by casting or swaging for example, and therefore the cable bolt is provided in a predetermined length. Accordingly, a cable bolt must be ordered and supplied to the excavation site, depending on the borehole depth. This is often not practical, where the depth of boreholes needs to be varied from area to area.

Another cable form of rock bolt is disclosed in U.K. Patent Specification No. GB2084630A. The cable disclosed therein has an anchored swivel at one end of the cable which is inserted into the borehole in order to secure the bolt. At the other end of the bolt there is provided a portion of rigid bar onto which a plate and nut can be fitted. In manufacturing the rock bolt GB2084630A difficulty is encountered in attaching a rigid bar to the cable and also relatively higher costs are involved in its manufacture. Problems similar to that of DE3435117A with regard to varying borehole depth equally apply in respect of the bolt disclosed in GB2084630A.

A further problem encountered with rigid bar bolts as noted above is their limited load carrying capacity per unit bolt diameter. When the rigid bar bolt is in situ, the load of the rock forming the immediate roof of the excavation which is to be supported is transferred to the rigid bar or known cable form via a plate by means of the threaded area between the nut and rigid end of the known bolts.

Devices of this general type which are inserted into drillholes and bonded to the rock are subject to possible axial forces and shear forces, the latter occurring as a result of at least partial sideways movement of certain rock zones. Thus, to prevent premature yielding of the device when rigid bars are used, there is a tendency to use bars of greater diameter. However, this necessitates use of a heavier and more expensive bar and requires a larger diameter borehole to be drilled into the rock. It would be seen of advantage to keep the diameter of the exposed end of the bolt small because small holes are more suited for maximum drilling speed and to form a small annular zone between the borehole and the bolt for efficient resin mixing and maximum bond strength development. It would be an advantage to provide a cable rock bolt which is able to carry larger loads than that of known rigid bars of the same diameter so that borehole diameters and time of drilling and installation can be kept to a minimum.

It has also been found to be sometimes difficult to agitate resins in the borehole to ensure correct mixing of constituents due to the substantially cylindrical nature of some prior art bars.

OBJECTS OF INVENTION

An object of the present invention is to alleviate some of the problems of the prior art.

A further object of the present invention is to provide a cable bolt for earth or rock stabilisation which is adapted for fitment into a borehole irrespective of its depth.

A further object of the present invention is to provide a cable bolt adapted for use with relatively small diameter holes.

A further object of the present invention is to provide a cable bolt which is adapted to carry relatively larger loads.

A further object of the present invention is to provide a means of agitating resin in a borehole in association with a cable bolt.

A still further object of the invention is to provide a method of support with the end of each support formed simply including formation at the face on segments of cable taken from a reel attached to an automatic support placement machine.

SUMMARY OF INVENTION

The present invention provides a device adapted for rock or earth stabilisation and reinforcement. The device is provided in the form of a single stranded cable or cable bolt. The cable bolt of the present invention is adapted to have a nut fitted directly onto one end of the cable. There is no need to have pre-threaded cables. The present invention enables fitment of the nut directly onto the cable. The cable may be cut, in situ, to any desired length, and have a nut fitted directly to an end of the cable. In this way, cables or rigid bars of fixed length are therefore no longer required.

The present invention further provides a cable bolt which comprises a plurality of wires. One end of the cable bolt is adapted to have a thread rolled thereon. A nut placed on the threaded portion of the cable bolt serves to interengage the wires of the cable. This allows load to be transferred to each wire of the cable. The cable bolt is therefore adapted to carry relatively larger loads than known bars with rigidly formed ends.

The wires of the cable bolt of the present invention may be interwound, bunched or otherwise arranged. In a preferred form of the present invention, the wires are parallel laid although cross lay may also be utilized. The contact areas between wires of the bolt thus extend along the surface of each wire for the entire length of the cable. The present invention further provides a cable bolt, formed of a plurality of wires, which has a relatively dense construction of wires in strand cross-section. Filler wires may also be provided in between outer and inner lays of wires, to provide an even greater area for the transfer of load from the nut to the cable wires.

The present invention also provides a cable bolt, the outer wires of which are wound with a lay direction opposite to the screw direction of the thread or spin direction of the cable. A lay direction opposite the thread direction is preferred, however, a lay direction the same as the thread direction can also be used in the present invention. The cable bolt of the present invention may advantageously be installed in a borehole together with a resin/grout cartridge. The lay direction of the outer wires as noted above provides a number of advantages. One advantage is that after a nut is threaded onto one end of the cable bolt, the cable bolt is usually made to rotate until the resin in the borehole around the other end of the cable bolt sets. The lay direction being provided in a direction opposite to the screw direction of the thread, or spin direction of the cable, serves to cause a pumping action on the resin in the borehole, and pumps the resin toward the closed end of the borehole. This pumping action serves to agitate and mix the resin before it sets.

Another advantage provided by the lay direction of the outer wires is that it serves to reduce de-lamination of the wires of the cable bolt as a result of threading the nut onto the cable. The lay direction also serves to lock up the outer wires as they are rotated in the thread direction during rolling of the thread and enables a consistent thread to be formed on each outer wire of the strand.

The present invention provides a cable bolt comprising at least two wires, the bolt being adapted to have a nut threaded directly onto at least one of the wires. The cable bolt may have the at least two wires interwound.

The present invention also provides a cable bolt comprising a central wire and an outer layer formed of a plurality of wires wound about said central wire, a thread form formed directly onto the wires in said outer layer at one end of the cable bolt, said thread form being adapted to have a nut threaded thereon.

In one form the cable bolt may have at least one intermediate layer provided between said central wire and said outer layer, the wires in said intermediate layer or layers and said outer layer being wound around said central wire in a predetermined lay direction with the wires in each layer being substantially parallel to one another.

The thread form may be rolled onto the wires of said outer layer.

The thread form may be rolled in a direction opposite to the lay direction of the outer layer.

The free ends of the wires located at one end of the cable bolt may be secured to one another, for example, by welding.

The formation of the thread may serve to interengage wires forming said cable bolt.

The present invention also provides a method of installing a cable bolt in a rock or earthen formation, said method comprising the steps of:

forming a borehole in said rock or earthen formation;

placing a settable securing material cartridge in said borehole followed by cable bolt material from a storage facility for said cable bolt material;

separating a predetermined length of said cable bolt material from said storage facility and securing ends of wires of the cable bolt material at a free end of the cable bolt material;

rolling a thread form on said free end of the cable bolt material;

applying a plate and a retaining nut to the thread form on said cable bolt material;

rotating said cable bolt material to activate said securing material cartridge; and once said securing material has set, tightening said nut on said thread form. The present invention may further provide a cable adapted to use as a cable bolt, said cable comprising at least two wires. The present invention still further provides a nut adapted to radially compress wires of a cable bolt. The nut may have at least one axial slot therein. The present invention still further provides in combination, a cable bolt comprising at least two wires, an outer surface of the cable bolt having at least one depression formed therein; and an end fitting adapted to co-operate with said depression whereby in use removal of the end fitting from the cable bolt by axial movement only is substantially prevented. The depression may be formed by a groove in one of the wires. The present invention also provides a method of providing an end fitting on a cable bolt, said method comprising the steps of:

a) providing at least one depression proximate an end of said cable bolt, said depression being adapted to co-operate with said end-fitting; and b ) installing said end fitting directly onto said cable bolt in a manner in which the end-fitting is substantially held in place on said cable bolt.

A preferred embodiment of the present invention will now be described with reference to the accompanying drawings, wherein like numerals are used to refer to the same component parts, and wherein:

FIG. 2 shows in cross-section, a preferred form of cable bolt in accordance with the present invention.

FIG. 4 shows a preferred method of manufacturing and installing a cable bolt in accordance with the present invention.

Figure 5:
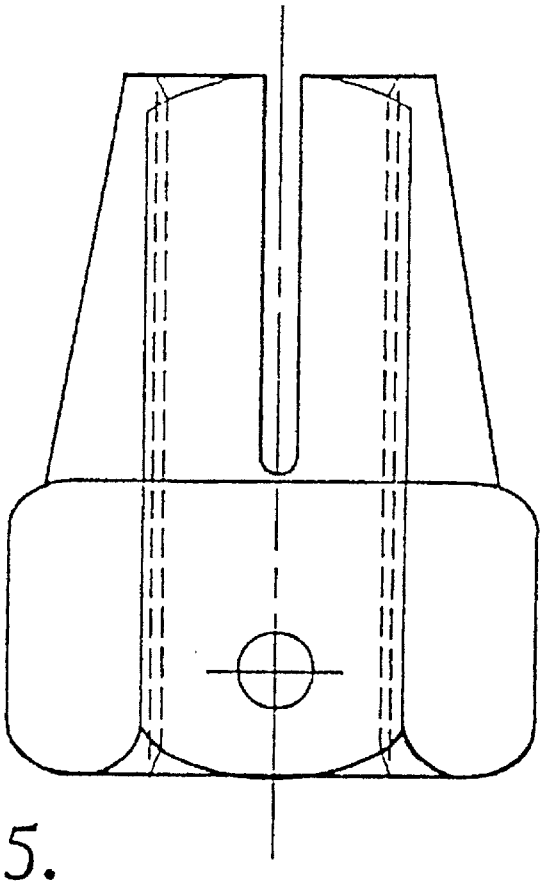
FIG. 5 shows one form of one nut.
Figure 5A:
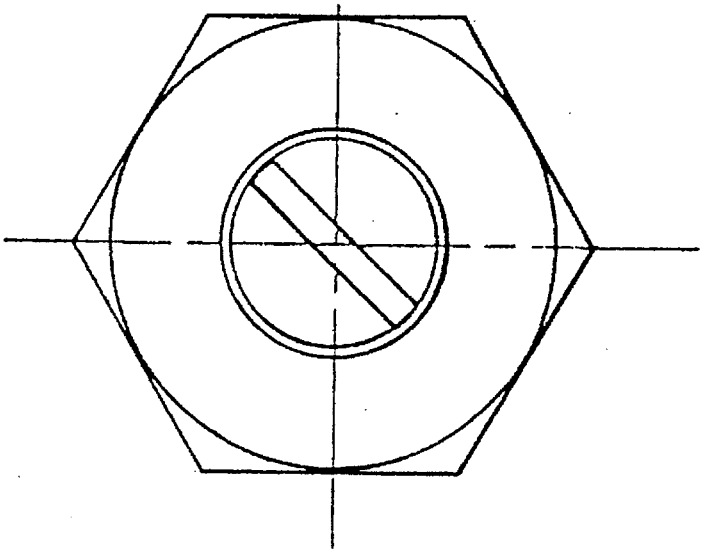

FIG. 5*a* shows a top view of the nut shown in FIG.5.

Figure 6:
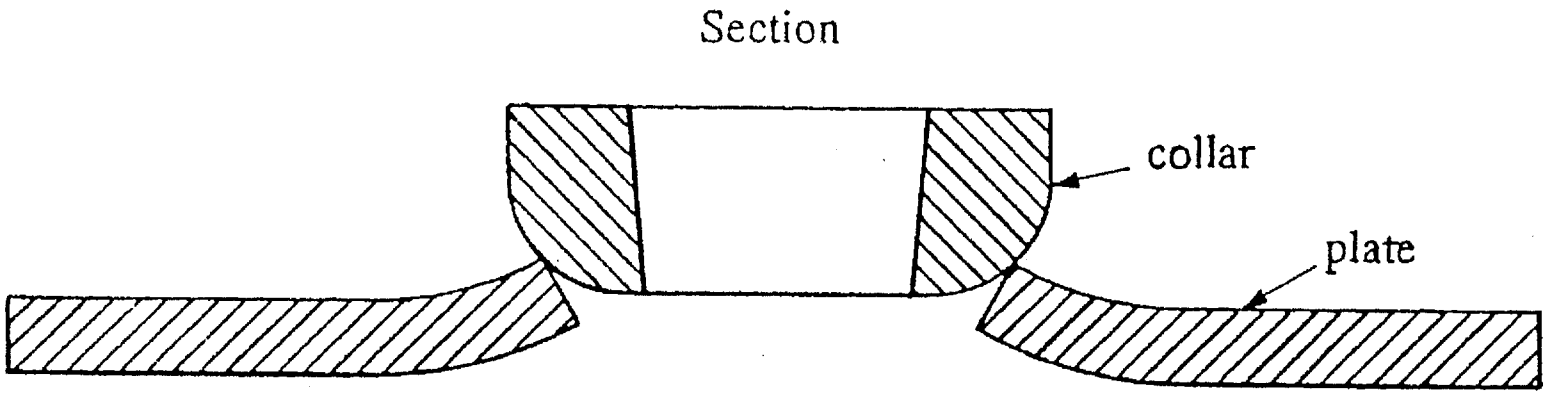
Figure 7:
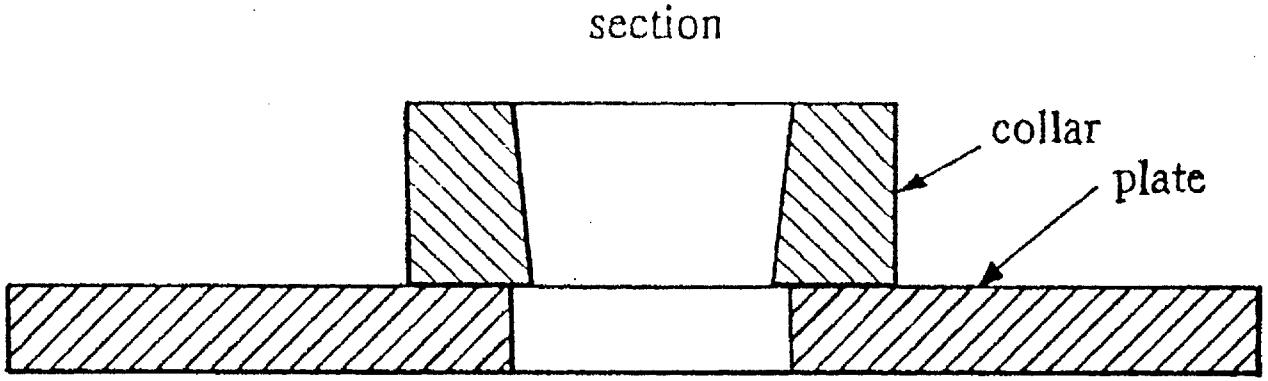

FIG. 6 and 7 show examples of collars and plates.

Figures 8, 8A:
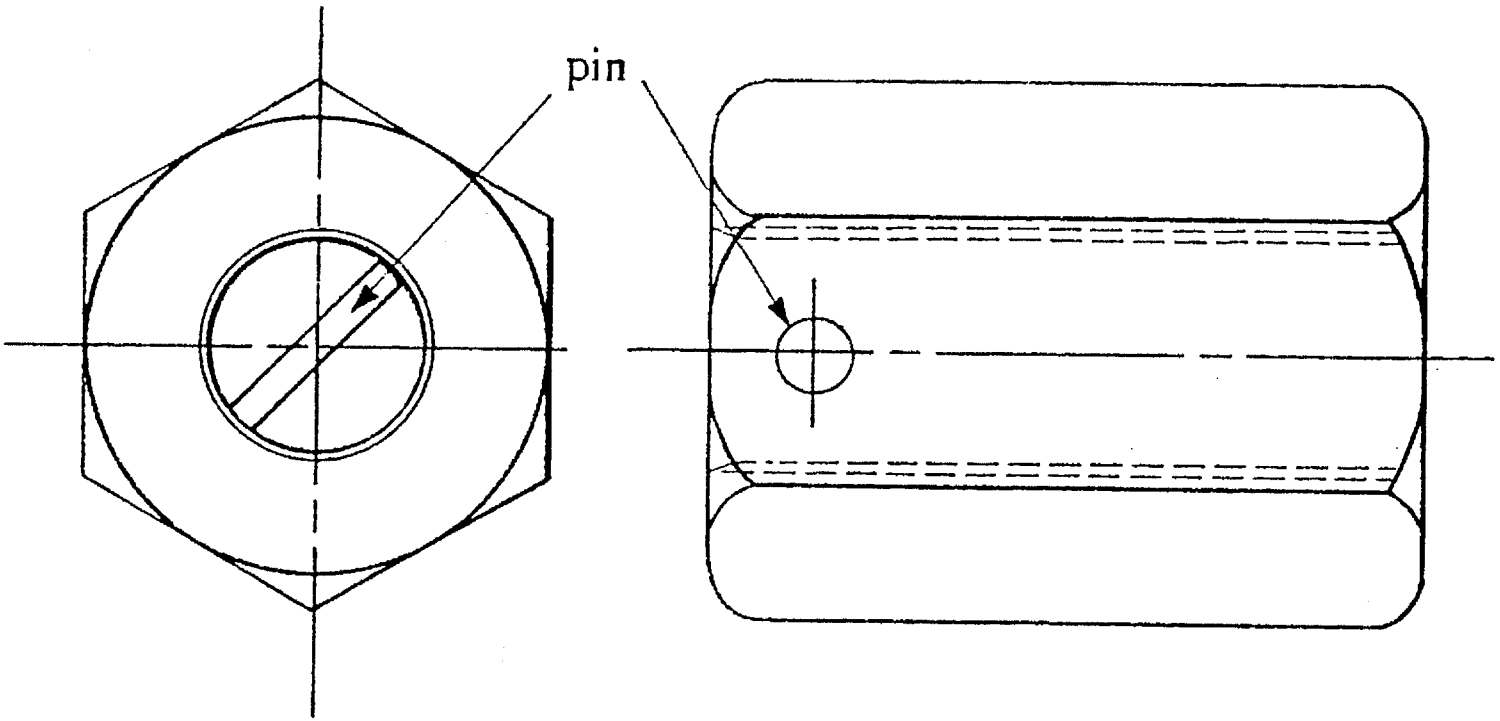

FIG. 8 shows one form of conventional nut.

FIG. 8*a* shows a side view of the nut shown in FIG.8.

Figure 9:
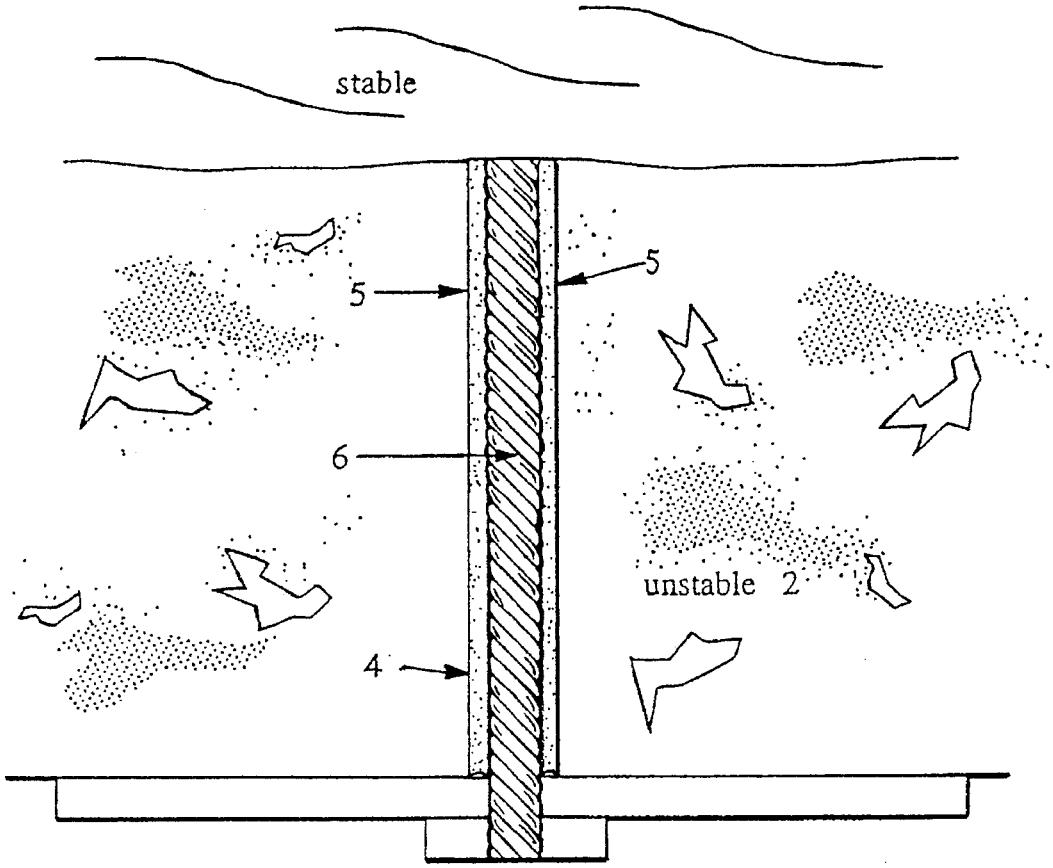

FIG. 9 shows diagrammatically the present cable bolt used as an earthen or rock stabiliser.

Figure 10:
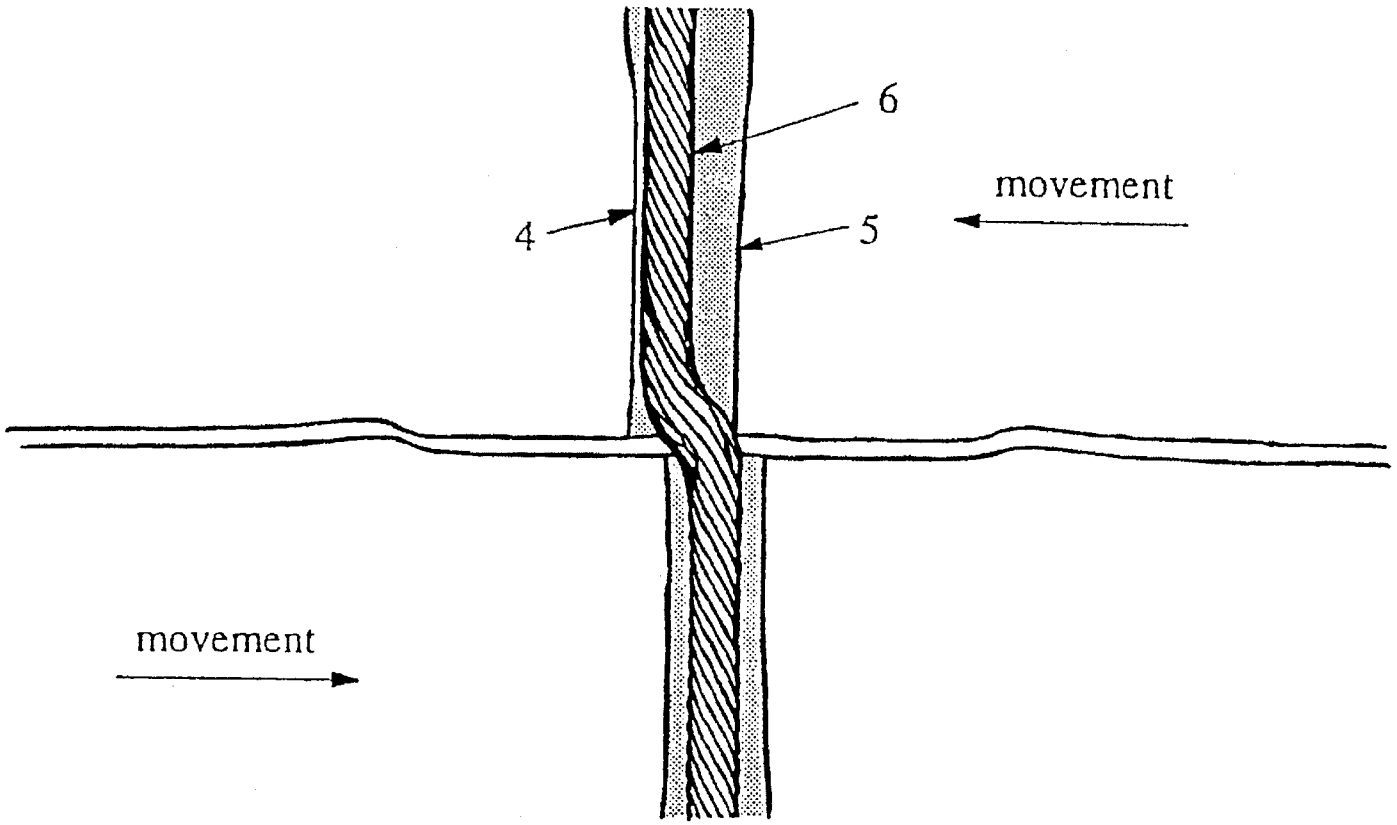
Figure 11:
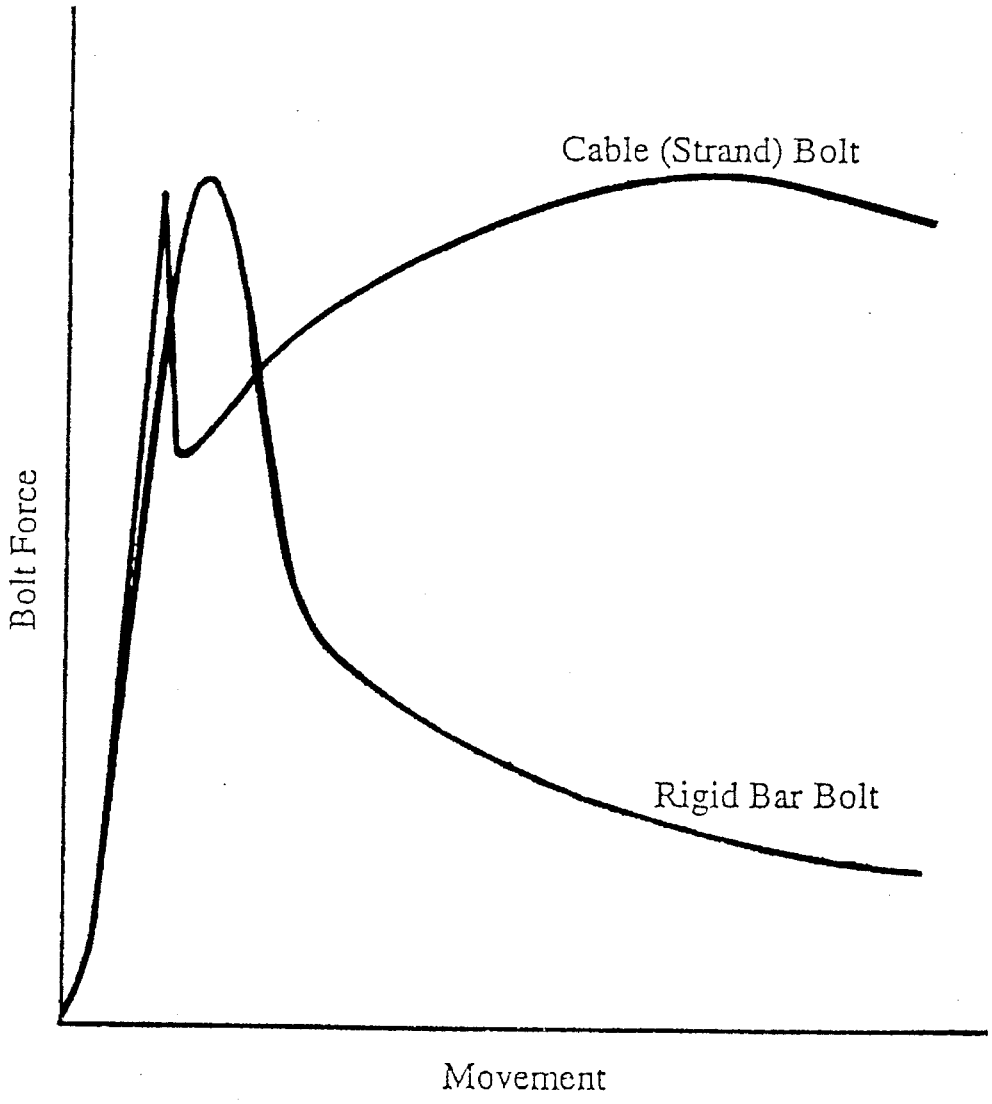
Figure 12:
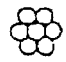
Figure 12:
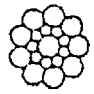
Figure 12:
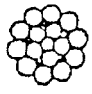

FIG.10 shows diagrammatically the present cable bolt when subject to lateral movement;

FIG.11 shows graphically a representative comparison of holding between the present cable bolt and prior art rigid bar; and FIG. 12 is a table showing preferred strand cross-sections and diameter ranges for the cable bolt.

The present invention provides a cable bolt, which has numerous applications, for example in building or civil construction, rock and earth stabilisation and/or reinforcement, or any other application which currently involve the use of cables or rods as fixing elements or as reinforcement.

A preferred embodiment of the present invention will be described with regard to an application in earth or rock stabilisation. The present invention should, however, not be seen as being limited to such an application. For example, the cable bolt may be used in a supporting function, FIG. 9, in which the cable bolt 6 may be substantially fully encapsulated by resins in a bore hole 4. In this way, the bolt may act to reinforce an unstable portion of earth 2 and enhance its strength properties so it becomes self supporting.

Furthermore, although the present invention is disclosed in the embodiment with only one threaded end, it is to be understood that applications exist where both ends of the cable bolt can be threaded in a similar fashion to the one end described, to receive a nut.

Figure 1:
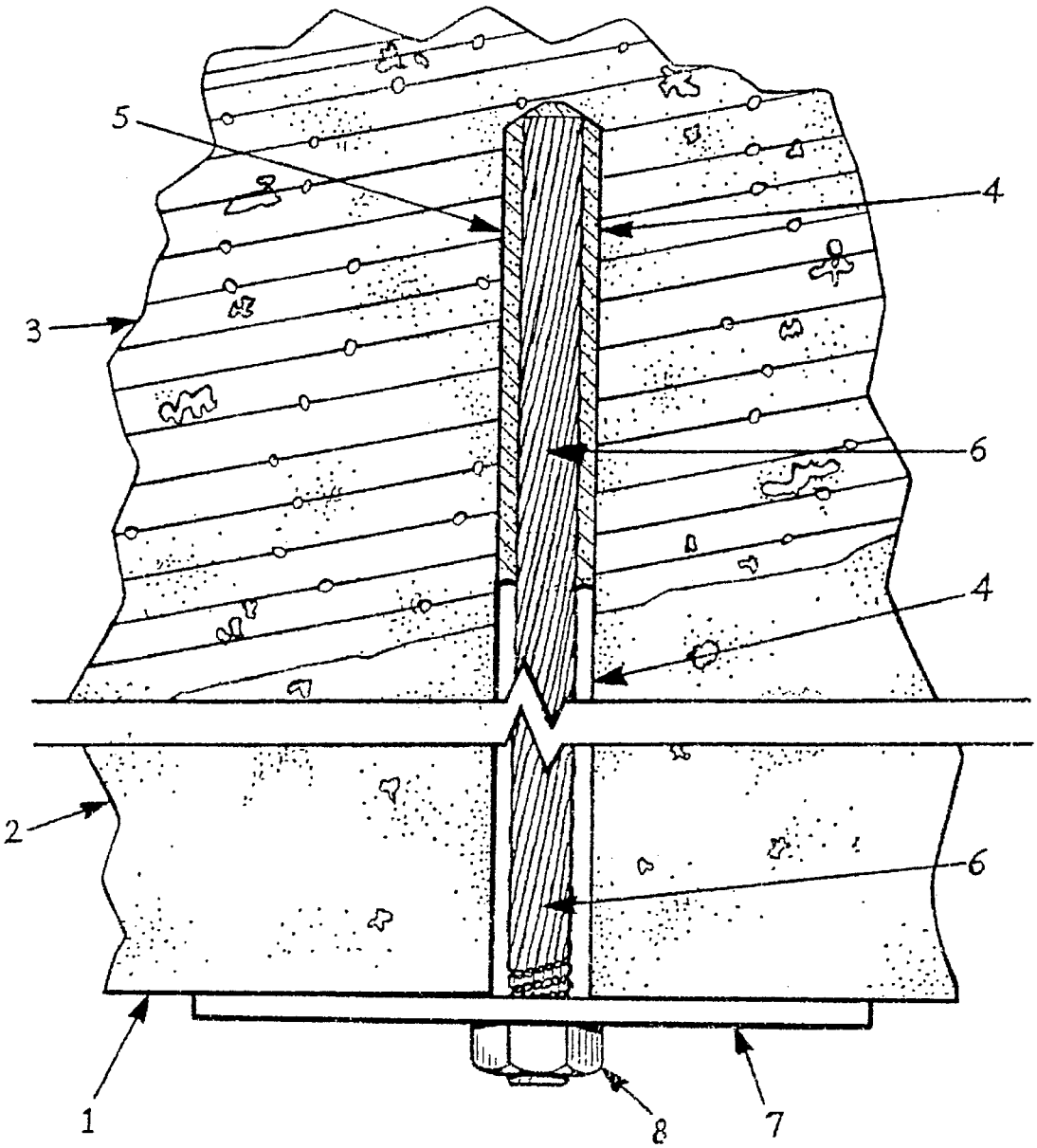
FIG. 1 shows a right hand lay cable and a fight hand threaded nut, being one form of cable bolt of the present invention installed in a borehole.

Thus, with reference to an application of the present invention in the field of earth or rock stabilisation, and in particular a mining or tunnel excavation, FIG. 1 shows a roof section 1 of a tunnel. The rock above and forming the tunnel roof 1 comprises, for example, a relatively unstable portion 2, and a relatively stable portion 3.

In such situations a cable bolt according to the present invention is installed, to reduce the risk of the unstable portion of the tunnel collapsing.

A borehole 4 is drilled into the tunnel roof, or wherever the earth or rock requires stabilisation, to a depth which enables one end of the cable bolt to preferably be fixed to the more stable portion 3. Each borehole depth may vary from hole to hole, depending upon the location of a suitable portion.

Grout 5 is inserted in the borehole 4, in a manner known to the skilled person, and the cable bolt 6 of the present invention, shown of length greater than the length of the borehole to enable a nut and plate to be fitted on the exposed end, is thereafter inserted into the borehole. There are situations where grout 5 would be inserted after the cable bolt 6.

A threaded portion may be formed prior to or subsequent to installing the cable bolt. It is usual practice however, in the art to form the thread prior to installation of the cable bolt. The threaded portion is preferably formed by rolling. It is believed that thread cutting would remove metal from the outer wires of the cable and reduce the load carrying capacity of the cable bolt whereas rolling deforms the metal and creates a raised edge which protrudes slightly above the preformed surface of the outer wires. The deformation is also believed to work harden the outer wires thereby increasing their, strength which partly compensates for the reduced cross section area caused by thread forming.

In installation, a plate 7 is placed on the cable bolt 6, and then a nut 8 is threaded onto the cable bolt to hold the plate 7 against the tunnel roof 1.

As described above, the plate 7 serves to hold the unstable portion 2 in place by reducing its ability to break away from the stable portion 3. The purpose of the plate, should be to transfer any surface rock movement into stretch in the cable which results in a resistance force being generated in the cable which acts on the plate and which resists further movement of the surface. More details of the load transfer will be hereinafter described with reference to FIG. 3.

FIG. 2 shows one form of cable bolt in accordance with the present invention. The cable bolt has one king or central wire 9, an inner layer of five wires 10, an outer layer of ten wires 11, and filler wires 12 placed between the outer and inner layers.

It is important to note that FIG. 2 shows only one exemplary form of the. present invention. The present invention may comprise any number of wires, strands, ropes and cables, depending upon the application.

is to be noted that, in cable cross section larger load carrying capacity may be provided by forming the cable of a relatively large number of wires, each wire having relatively high strength. The use of a plurality of wires enables each wire to carry a portion of the load.

STRAND GEOMETRY

Strand geometry can be selected according to the following criteria:

- outer wire diameter needs to be sufficiently large so that thread or groove indentations do not exceed 20% of outer wire diameter and to provide sufficient flexural rigidity for the strand; experience has indicated that outer wires in the diameter range 5.0 to 5.5 mm are preferred;
- given the above requirement for outer wire size, the number of outer wires depends on the strand diameter required; and
- core wires, if appropriate, and the central wire of the strand must preferably have a diameter that will allow them to be formed into a "close packed"structure (i.e. each core wire has as many contacts as possible with other core wires, the central wire and the outer wires). Note that to achieve a close packed structure, a parallel lay strand construction is required. However, it is also possible to have a cross-lay construction in which the outer wires are wound with a lay direction opposite to the core wires, as herein disclosed.

Examples (only) of preferred strand cross-sections and diameter ranges are shown in FIG. 12. These are typical examples of size ranges that would be suitable for the cable bolt when it is used for fully bonded rock support/reinforcement installed with resin cartridges. Many other types and/or forms of cable bolt are contemplated in accordance with. the application to which the bolt is to be subjected. The present description is to be used by an artisan as a guide to the construction/configuration of other types and/or forms of cable bolt.

Referring to FIG. 2, one form of cable bolt as described above, has application in the mining field.

The dimensions and make up of the particular strand cable that may be used are as follows: a central king wire is 3.80 mm in diameter, king wire is surrounded by five (5) wires each 4.53 mm in diameter, five (5) filler wires of diameter 2.1 mm are used in the outer grooves between the 4.53 mm diameter wires, and ten (10) wires 4.9 mm in diameter are wound around the outside.

The outer diameter is approximately 23.1mm.

Noting the above, trials of the cable of one form of cable bolt have shown: the outer wire diameter should be as large as possible compatible with the outer strand diameter required and flexibility (i.e. bending stiffness). For a strand with diameters in the range 22.8–23.3 mm, a design with ten (10) outer wires has been found to allow a low enough bending stiffness for mining ground support applications. Similarly, a strand with a diameter range from 15.2 to 16.0 mm with six (6) outer wires is still flexible enough for the above purpose. With both these size ranges, the outer wire diameter is preferably in the range 5.0 to 5.5 mm.

All wires in the strand except the centre (or king) wire should be wound in parallel lay with a lay direction opposite to the screw direction of the thread.

The cross sectional area within the core of the strand (i.e. the area bounded by the total number of outer wires arranged in their radial position) is to be as tightly packed with wires as possible. This is required to maximise the number of radial contacts for each wire in the core and to maximise the radial compressive stiffness of the core. The breaking strength of the cable is partly dependent on the ultimate strength capacity of the wires selected for the core.

The above are considered to be important where the thread is rolled on the outer wires. A rolled thread is preferred unless the outer wires are sufficiently large enough to enable thread cutting, as it is usually not possible to achieve adequate thread depth for load transfer purposes without excessively weakening the outer wires if the thread form is cut into the wires. In other words, there may be an optimum condition of thread depth and outer wire diameter at which the outer wire strength is equal to the failure strength of the thread when a nut of a specific length is used.

An indentation in an outer wire may otherwise be provided, the indentation co-operating with a suitable end fitting. For example, the end fitting may simply be clipped onto the end of the cable bolt, where a protrusion of the end fitting co-operates with the cable indentation.

It is preferred that the core is densely packed with wires. The cable bolt of the prescribed invention in conjunction with a cone nut or tight fitting conventional nut utilises the phenomena of the nut compressing the outer wires onto the inner core wires which may in turn be compressed onto the king wire to develop sufficient friction between the wires, so that, for example, as the outer wires stretch under load, the inner wires also stretch and build up tensile load. If this does not occur, the tensile strength of the cable bolt is only that of the outer wires, and reduced load carrying capacity results.

For increased load capacity of the threaded cable it is preferred that the cable be formed by winding the wires around the central king-wire without using lubricants of any kind (rope manufacturers often use grease during the manufacturing process for corrosion protection during the life of the product). Where lubricants are used, premature slippage may result between inner and outer wires.

When a cone nut is used, it is preferable that the outer wire diameter is selected to allow a small space between each outer wire. This allows the nut to squeeze the outer wires onto the inner core wires more effectively and assist in the loead transfer to the inner core wires. This is not always the case with a parallel (conventional) nut. The squeezing action is considered not to be essential to the working of the present invention where there are small spaces between each outer wire, these gaps also allow the grout or glue used to bond the strand to the rock (portion 3 of FIG. 1) in a borehole to penetrate the voids between outer and inner core wires thereby increasing the bond strength.

Where the load capacity of the threaded strand/cone nut assembly is to be close to the maximum and/or at least 80% of the nominal breaking strength of the strand, none of the wires used to construct the strand should be coated with anti-corrosive layer (such as galvanising). These coatings tend to reduce the radial stiffness of the strand and serve to provide a lubricating effect on the wire surfaces when in contact with each other. Both these aspects tend to detract from the frictional load transfer between the outer and core wires. Coatings which may significantly increase friction may be an advantage.

Figure 3:
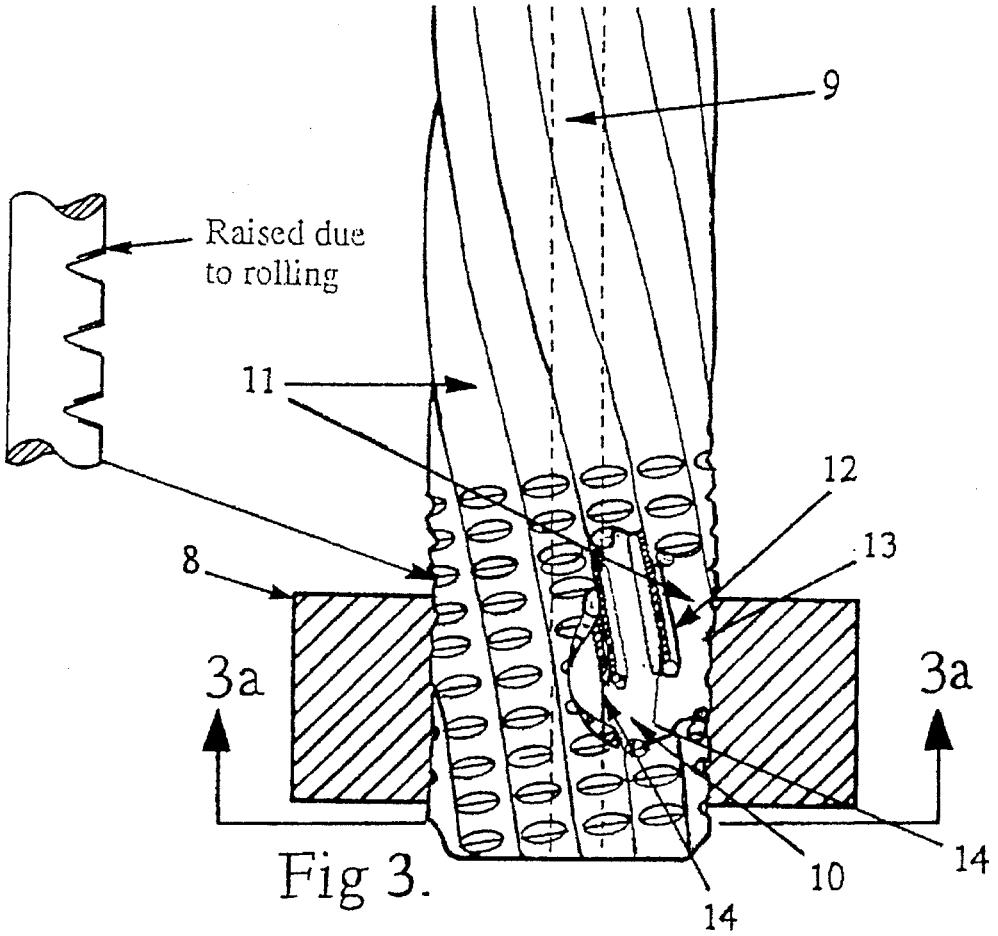
FIG. 3 shows in section, a left hand lay cable and the threaded end of a cable bolt in accordance with the present invention, with a nut in place.
Figure 3A:
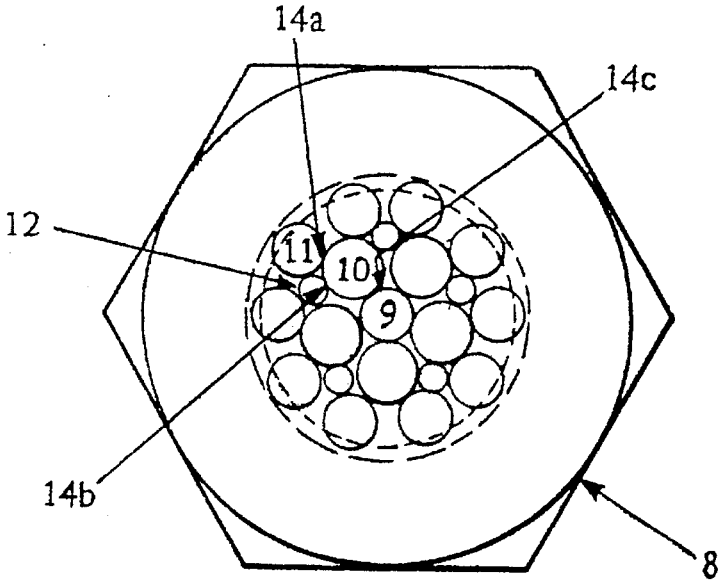
FIG. 3*a* is a view of the threaded end of a cable bolt taken along lines 3*a* of FIG. 3.

FIG. 3 shows, in cross section, the interaction of wires of the cable bolt of the present invention. It is to be noted that, although central, inner and outer wires are shown of equal cross-sectional area, the wires of the cable bolt may be of any varying cross-sectional area in order to achieve a desired strength capacity.

The central (king) wire is shown as being straight.

A rolled thread 13 is provided on the outer layer of wires 11. The rolling of the thread has the added effect of engaging the wires of one layer to the wires of another layer. Deformations 14 may be formed where the wires are compressed together, in the case where a cone nut is used.

Interengaging of these deformed areas serves to improve load carrying ability of the cable. These contact areas 14 serve to transfer or distribute the load applied to nut 8 to the wires of the cable bolt, and therefore increase the load capacity of the cable bolt.

In addition to the interengagement of the wires noted above, a compression nut (for example the nut shown in FIGS. 1A or 5) or a nut which provides an interference fit with the cable bolt, may serve to provide compressive forces radially on the wires. The slots formed in the nut may be configured to allow compression of cable wires as the nut is tightened. The slots may be oriented axially and/or radially. Also, the cone section may be separate to the nut and be engaged by the nut to rotate both cone and nut. The slots may also allow be configured to allow for movement of the plate and collar in an axial direction.

As shown in section A—A, where the wires are deformed at their interengaged surfaces during rolling the wires increase the area and extent of their contact. Where the wires are not deformed, they preferably are arranged to engage each other. Thus wire 11 engages inner wire 10 at 14*a* and also engages filler wire 12 which in turn engages inner wire 10 at 14*b*.

Inner wire 10, likewise deforms and interengages its neighbouring wires, and in particular king wire 9 at 14*c*. As is shown, each wire of the cable, in this example, is slightly and locally deformed by the thread rolling process to increase contact area between itself and its neighbouring wires. This serves to assist in distributing the load from the nut, to each wire of the cable bolt.

The nut 8 design depends on the load capacity desired. Preferably, the thread matches the form of the rolled thread on the outer wires. As shown in FIGS. 1, 3 and 8, the nut may be of conventional shape and length if adequate load transference can be achieved thereby. For example, the nut as shown in FIG. 8 in conjunction with a 23.1 mm diameter cable bolt has been tested to transfer capacity as follows:

| Nut load transfer capacity (tonnes) | Nut length (mm) |
|---|---|
| 20 | 30 |
| 26 | 36 |
| 30 | 42 |
| 35 | 48 |

Figure 1A:
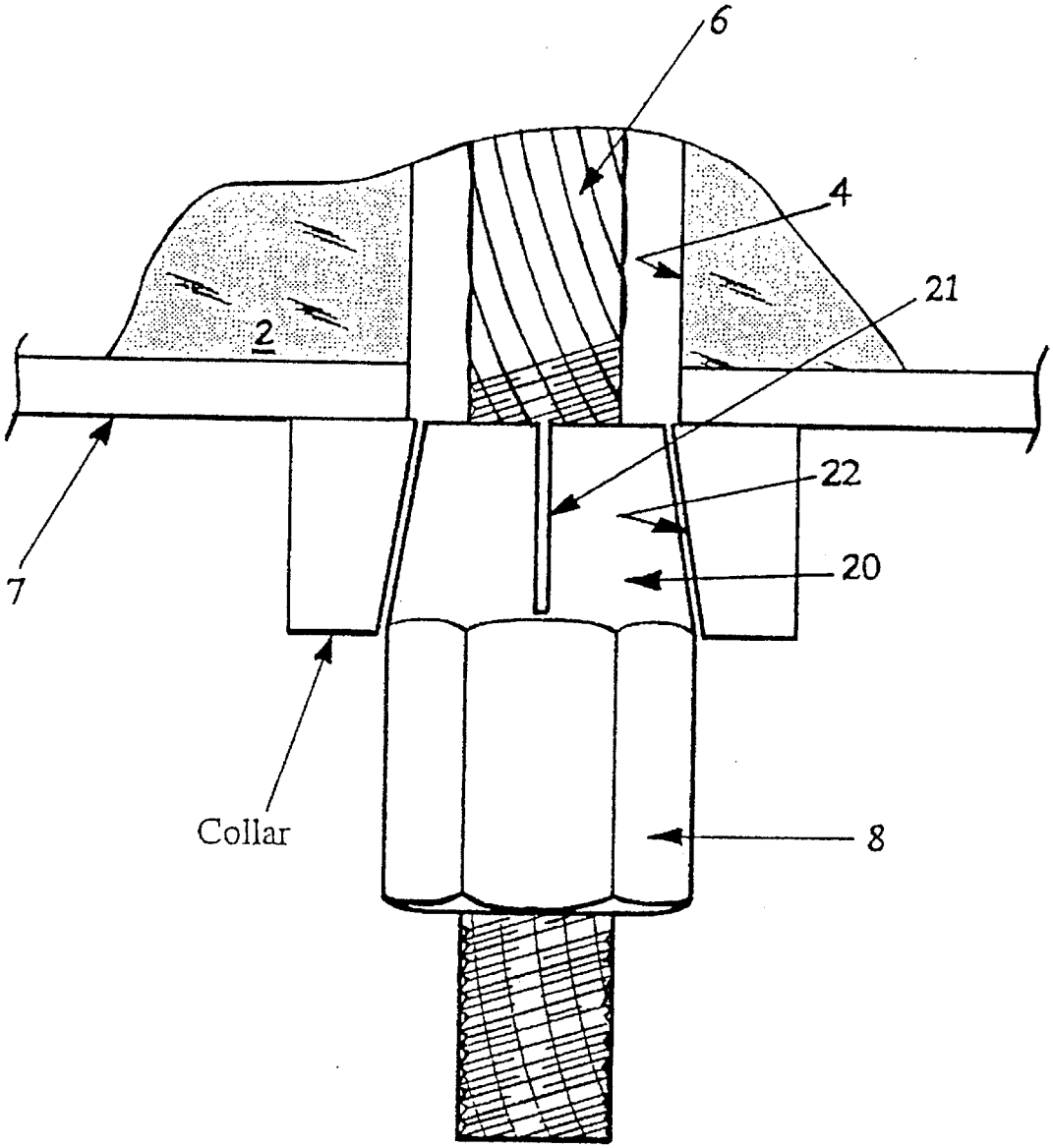
FIG. 1A shows a left hand lay cable and an alternative form of retaining nut.

The nut can transfer a minimum force equivalent to the strength of the outer wires. If there is some wire interaction, for example by friction or wire compression, the transfer force can be increased. If improved load transference is needed, the nut as shown in FIGS. 1A and 5 with a frusto-conical end piece 20 might be used. The end section 20 has conveniently two sets of diametrically opposed axial slots 21 to allow the opposed regions of the end section 20 to be compressed against the cable as the nut is threaded thereon and is screwed into a complementary tapered opening 22 in the collar piece used in association with a plate.

Particular collar and plate embodiments are shown in FIGS. 6 and 7. A 7° taper on the cone used in conjunction with a collar with a 7° tapered hole with 3 mm wide slots in the cone allows the opposed regions of the end section 20 to provide adequate compression when the nut in FIG. 5 is used in conjunction with a 23.1 mm diameter cable bolt. The collar in FIG. 6 has a spherical surface machined on part of its outer surface to locate and bear on a deformed plate as shown. An advantage of this arrangement is that it allows for some plate misalignment from a plane which is perpendicular to the axis of the belt. In situations where bolts are installed perpendicular to the rock or earth surface, a cylindrical shaped collar in Figure 7 can be used in conjunction with a flat plate. Collars of the type shown in FIGS. 6 and 7 manufactured from medium strength steel provide sufficient confinement of the nut in FIG. 5 if the collar outside diameter is at least 50 mm and the length is at least 22 mm.

Furthermore, the rolling of the thread is preferred as this deforms the metal of the wires so there is a reduction in cross section area of the outer wires of the cable bolt, but this is compensated to a degree by the extra strength in the wires due to work hardening proximate the threaded area. Forming the thread in this way obviates the need to use a rigid bar and alleviates a prior art problem where there may be premature yield of a rigid bar subjected to shear deformation.

FIG. 10 illustrates the typical profile that a rock bolt is subjected to after shear movement in the rock has occurred. A rigid bar bolt of the prior art has been found to be forced to yield and fail after a relatively small shear movement, whereas in the cable bolt of the present invention localised movement between individual wires occurs to allow relatively high shear movement before wire failure occurs.

Tests of the present cable bolt have also shown that if the end of the cable bolt moves or is pulled out of a stable zone, an increase in the holding force of the cable bolt in the borehole develops. A rigid bar has been found to merely slip out of the borehole in this situation. FIG. 11 diagrammatically illustrates a comparison between the present cable bolt and a rigid bar in such a situation.

With reference to FIG. 4, a preferred method of utilising the cable bolt of the present invention is described.

The steps are as follows in this preferred example, however, the following steps are not applicable in all installations of the cable bolt in accordance with the present invention:

(a) Forming a borehole into the excavation rock which is to be stabilised by a cable bolt in accordance with the invention;

(b) Cutting a length of cable (V) from a drum of cable either after feeding cable from the drum into the borehole or prior to insertion of the cable into the borehole. In either method the length is cut to suit the depth of the hole of step (a) above.

(c) At least the end of the cable on to which the thread is to be rolled is welded (W) to hold the ends of the wires together thereby reducing the likelihood of delamination of the wires of the cable. If desired, some other mechanical or other known method could be used to secure these wire ends together.

(d) Rolling a desired thread form onto the end of the cable length secured together by welding or by some other means such that the outer wires of said cable become locally delaminated in the area of the thread rolling where the outer diameter of the cable increases slightly from the welded or otherwise secured end.

(e) Placing a stabilisation plate with an opening therein over the projecting end of the cable length in the borehole.

(f) Threading a nut onto the projecting end of the cable length until such stage as the nut stiffens on the thread as a result of the expanded cable diameter or until the end of the cable contacts the pin placed across the threaded portion of the nut as shown in FIGS. 5 and 8.

(g) Installing the cable length into the borehole in the rock face if this has not already occurred. Generally, the cable is installed with a plate and nut already fitted. The nut is used to spin the bolt during installation.

(h) Rotating the nut and cable together so as to break a fast setting resin cartridge pre placed in the borehole and to thoroughly mix the resin materials to secure the inner end of the cable to the adjacent rock wall within the borehole. The arrangement of the wound wires of the cable having a lay direction opposite to the thread rolled thereon, when rotated in the direction of the thread, provides a pumping action to the resin materials so that they tend to move inwardly within the borehole rather than outwardly therefrom while the resin remains liquid.

(i) When the resin has set, the nut is then forced onto the thread of the cable end to fail the pin and to press the stabilisation plate firmly against the rock face. Alternatively, it is envisaged that the outer wires can be welded together and thereafter a thread rolled on either side of the weld. The cable may be then cut through the welded section. In another alternative, the cable (or a portion thereof) may be thread rolled. first, after which the cable may be cut to a desired length.

BENDING STIFFNESS

In order to successfully install the cable bolt by spinning it through one or more resin cartridges, the strand must have sufficient flexural (bending) rigidity so that it does not bend when the thrust is applied to the end of the bolt during installation. This property of the strand is primarily a function of the number of outer wires, the outer wire diameter and the radial distance of the outer wires from the centre wire. Single strand cable bolts of the configurations and diameter shown above have sufficient flexural rigidity to be installed by the method indicated in the specification.

OUTER WIRE INDENTATIONS

Although the specification as it now stands covers indentation of part of each outer wire so that a thread is formed, rolled or cut around the strand, the indentations need not necessarily be arranged to form a thread. The combination of successive indentations around the outer wires to form a thread allows a threaded nut to be used as the "end fitting" to bear against a collar and/or plate.

Indenting the outer wires in this way is only one particular form of deforming the outer wires. Provided other types of end fitting could be used, the outer wires could be rolled with a set of parallel grooves normal to the strand axis (centre wire). Groove dimensions in each outer wire would be the same as for the case when a thread is formed on the outer wires of the strand. With the parallel groove type of indentation, the end fitting would need to be swaged or crimped onto the strand during manufacture and have an external shape (at least on the driven end) to allow it to be spun and hence spin the bolt during bolt installation. This end fitting would not allow the bolt to be tensioned during the installation process. The end fitting may be formed to simply "snap-on" to the end of the cable bolt.

Other forms of cable are also contemplated, such as a cable formed of non-round wires. The wires may be of trapezoidal, elliptical or triangular shape. These shapes may provide a more consistent thread, greater inter-wire contact area for load transfer and therefore higher load carrying capacity. The wires may also be formed with cross sectional shapes so as to interact in a half locked coil or full locked coil manner.

Although the present description discloses a cable bolt of a strand configuration, a cable bolt of a rope configuration is also herein contemplated.

We claim:

1. A cable bolt comprising:

a central wire and an outer layer formed of at least one wire wound about said central wire; a thread form formed directly onto the wires in said outer layer at one end of the cable bolt, said thread form being adapted to have a nut directly threaded thereon; and at least one intermediate layer provided between said central wire and said outer layer, the wires in said intermediate layer and said outer layer being wound around said central wire in a predetermined lay direction with the wires in each layer being substantially parallel to one another.

2. A cable bolt as defined in claim 1, wherein said thread form is rolled onto the wires of said outer layer.

3. A cable bolt as claimed in claim 2, and further comprising:

a nut threadably engaging said thread form, and squeezing the wire of the outer layer onto the wire of the intermediate layer, and squeezing the wire of the intermediate layer onto the central wire, such that upon loading of the nut, the outer, intermediate, and central wires are stretched.

4. A cable bolt defined in claim 1, and further comprising:

a nut adapted to squeeze the wire of the outer layer onto the wire of the intermediate layer, and to squeeze the wire of the intermediate layer onto the central wire, such that upon loading of the nut, the outer, intermediate, and central wires are stretched.

5. A cable bolt as defined in claim 1 wherein:

said predetermined lay direction is opposite the direction of the thread form.

6. A cable bolt, comprising:

at least two wires bound together to form a bolt, with at least one of the wires having an exposed outer surface; and a plurality of indentations directly formed on said exposed outer surface and defining a threaded screw portion onto which a nut may be directly threaded, said indentations comprising deformations roll formed into said exposed outer surface of at least one of the wires.

7. A cable bolt comprising:

at least two wires bound together to form a bolt, with at least one of the wires having an exposed outer surface;

a plurality of indentations directly formed on said exposed outer surface and defining a threaded screw portion onto which a nut may be directly threaded; and said at least one wire is wound with a lay direction opposite to the screw direction of said threaded portion.

8. A cable bolt comprising:

a central wire and an outer layer formed of at least one wire wound about said central wire;

a thread form formed directly onto the wires in said outer layer at one end of the cable bolt, said thread form being adapted to have a nut directly threaded thereon, and said thread form being rolled onto the wires of said outer layer.

9. A cable bolt as claimed in claim 8, and further comprising:

a nut threadably engaging said thread form and squeezing the wire of the outer layer onto said central wire, such that upon loading of the nut, the outer and central wires are stretched.

10. A cable bolt comprising:

a central wire and an outer layer formed of at least one wire wound about said central wire;

a thread form formed directly onto the wires in said outer layer at one end of the cable bolt, said thread form being adapted to have a nut threaded thereon; and a nut adapted to squeeze the wire of the outer layer onto said central wire, such that upon loading of the nut, the outer and central wires are stretched.

11. A cable bolt and nut combination, comprising:

at least two wires wound together to form the cable bolt, with one wire being an inner wire and the other wire being an outer wire and having an exposed outer surface;

a plurality of indentations directly formed on the outer surface of said outer wire to define a threaded portion, said outer wire being wound with a lay direction opposite to the screw direction of the threaded portion; and a nut rotatably threaded onto said threaded portion such that a load can be placed on the nut.

* * * * *